US006456000B1

(12) United States Patent
Lee

(10) Patent No.: US 6,456,000 B1
(45) Date of Patent: Sep. 24, 2002

(54) CATHODE RAY TUBE WITH ITO LAYER AND CONDUCTIVE GROUND STRIP

(75) Inventor: Sang-hoon Lee, Taejon (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 0 days.

(21) Appl. No.: 09/353,767

(22) Filed: Jul. 15, 1999

(30) Foreign Application Priority Data

Mar. 19, 1999 (KR) ..... 99-9351

(51) Int. Cl.[7] ..... H01J 31/12; H01J 1/52
(52) U.S. Cl. ..... 313/479; 313/477 R
(58) Field of Search ..... 313/479, 477 R, 313/478, 480, 461, 466, 473, 474; 174/126.2, 126.4

(56) References Cited

U.S. PATENT DOCUMENTS 3,746,904 A * 7/1973 Torre ..... 313/356
4,124,540 A * 11/1978 Foreman et al. ..... 252/518
5,025,490 A * 6/1991 Tamura ..... 313/479
5,223,765 A * 6/1993 Staron et al. ..... 313/478
5,444,329 A * 8/1995 Matsuda et al. ..... 3134/479
5,446,339 A * 8/1995 Kinoshita et al. ..... 313/478
5,451,840 A * 9/1995 Abe et al. ..... 315/85
5,520,855 A * 5/1996 Ito et al. ..... 252/582
5,652,476 A * 7/1997 Matsuda et al. ..... 313/478
5,757,117 A * 5/1998 Hirasawa et al. ..... 313/479
5,770,258 A * 6/1998 Takizawa et al. ..... 427/64
5,939,821 A * 8/1999 Itou et al. ..... 313/461
6,171,457 B1 * 1/2001 Kim ..... 204/192.28

* cited by examiner

*Primary Examiner*—Ashok Patel
*Assistant Examiner*—Karabi Guharay
(74) *Attorney, Agent, or Firm*—Leydig, Voit & Mayer, Ltd.

(57) ABSTRACT

A cathode ray tube (CRT) with enhanced electromagnetic wave shielding effect and antistatic without increased manufacturing cost. The CRT includes a panel with a screen, a funnel connected to the panel, having a cone portion and a neck portion, an electron gun inserted in the neck portion, a deflection yoke installed around the cone portion, an external conductive layer deposited on the external surface of the funnel, a transparent conductive layer deposited on the outer surface of the screen, having a resistance greater than $1\times10^5$ $\Omega/cm^2$ and equal to or less than $9\times10^5$ $\Omega/cm^2$, and a conductive ground portion electrically connected to the external conductive layer and attached to the cone portion of the funnel, facing the deflection yoke, and extending toward the neck portion.

10 Claims, 6 Drawing Sheets

CATHODE RAY TUBE WITH ITO LAYER AND CONDUCTIVE GROUND STRIP

BACKGROUND OF THE INVENTION

1. Field of the Invention

The present invention relates to a cathode ray tube (CRT), and more particularly, to an enhanced CRT structure capable of shielding electromagnetic waves.

2. Description of the Related Art

Recently, the hazards of electromagnetic waves emitted from monochromatic or color CRTs on human beings have become known, thus resulting in increases in restrictions on emissions of electromagnetic waves. In order to effectively cope with such restrictions, it is essential to be cost competitive by minimizing the cost required for shielding electromagnetic waves and an antistatic effect, as well as to maximize the effect of shielding the electromagnetic waves and the antistatic effect.

According to restrictions on emission of electromagnetic waves set by the Swedish Confederation of Professional Employees (TCO), a transparent conductive layer must satisfy the following characteristics.

Thus, resistance of a transparent conductive layer should be $10^9$ $\Omega/cm^2$ as an antistatic layer. Also, a transparent conductive layer as an electromagnetic wave shielding layer should have a resistance of $10^3$ $\Omega/cm^2$, a hardness of 5H or more and a transparency of 95% or more.

A transparent conductive layer satisfying the above conditions is formed of a metal such as platinum (Pt), gold (Au) or indium tin oxide (ITO) in the form of a thin film.

FIG. 1A shows an example of a conventional CRT on which a transparent conductive layer for shielding electromagnetic waves coats a screen.

As shown in FIGS. 1A and 1B the conventional CRT includes a panel 13 having a screen 12 with a fluorescent layer (not shown) at the inner surface, a funnel 14 connected to the panel 13, an electron gun 15 inserted in a neck portion of the funnel 14 and a deflection yoke 16 installed around a cone portion of the funnel 14. Also, a transparent conductive layer 17 is formed of ITO with a resistance lower than $10^3$ $\Omega/cm^2$ on the outer surface of the screen 12. The transparent conductive layer 17 is electrically connected to an implosion band 18 attached to a contact area between the panel 13 and the funnel 14. An external conductive layer 19 is formed on the outer surface of the funnel 14.

In the above CRT, electron beams emitted from the electron gun 15 are deflected by the deflection yoke 16 to land on the fluorescent layer. The electron beams excite a fluorescent material forming the fluorescent layer.

The electromagnetic waves from the deflection yoke 16 during the above operation are shielded by the transparent conductive layer 17 on the screen 12 and the external conductive layer on the external surface of the funnel 14, thereby suppressing emission of the electromagnetic waves outside the CRT.

For effective shielding of the electromagnetic waves, the transparent conductive layer 17 coating the screen 12 must have a resistance lower than $10^3$ $\Omega/cm^2$. However, forming the transparent conductive layer 17 of a material with such a range of resistance, e.g., ITO, raises the manufacturing cost of the CRT. Thus, it is not practical to use such an expensive material for the transparent conductive layer which shields the electromagnetic waves and provides an antistatic effect.

In considering the problem, a method using ITO with a resistance higher than $10^3$ $\Omega/cm^2$ or a method of applying an inverse pulse voltage to an external conductive layer synchronized with a deflection signal to cancel the electromagnetic waves, has been adopted.

However, using an ITO layer with a resistance of above $10^3$ $\Omega/cm^2$ does not provide a satisfactory shielding of the electromagnetic waves and the method of applying the inverse pulse voltage to the external conductive layer requires an extra circuit for applying the inverse pulse voltage and may increase the emission of the electrons if such applied voltage is not synchronized with the deflection of the deflection yoke.

SUMMARY OF THE INVENTION

To solve the above problems, it is an object of the present invention to provide a cathode ray tube (CRT) capable of improving the shielding effect on the electromagnetic waves and the antistatic effect, as well as lowering the cost which may be raised by forming a transparent conductive layer.

To achieve the above object, there is provided a cathode ray tube (CRT) comprising: a panel with a screen; a funnel connected to the panel, having a cone portion and a neck portion; an electron gun inserted in the neck portion; a deflection yoke installed around the cone portion; an external conductive layer deposited on the external surface of the funnel; a transparent conductive layer deposited on the outer surface of the screen, having a resistance greater than $1\times10^5$ $\Omega/cm^2$ and equal to or less than $9\times10^5$ $\Omega/cm^2$; and a conductive ground portion electrically connected to the external conductive layer and attached to the cone portion of the funnel, facing the deflection yoke, being extended toward the neck portion.

Preferably, the transparent conductive layer is formed of indium tin oxide (ITO).

BRIEF DESCRIPTION OF THE DRAWING

The above object and advantages of the present invention will become more apparent by describing in detail preferred embodiments thereof with reference to the attached drawings in which.

DESCRIPTION OF THE PREFERRED EMBODIMENTS

Figure 1A:
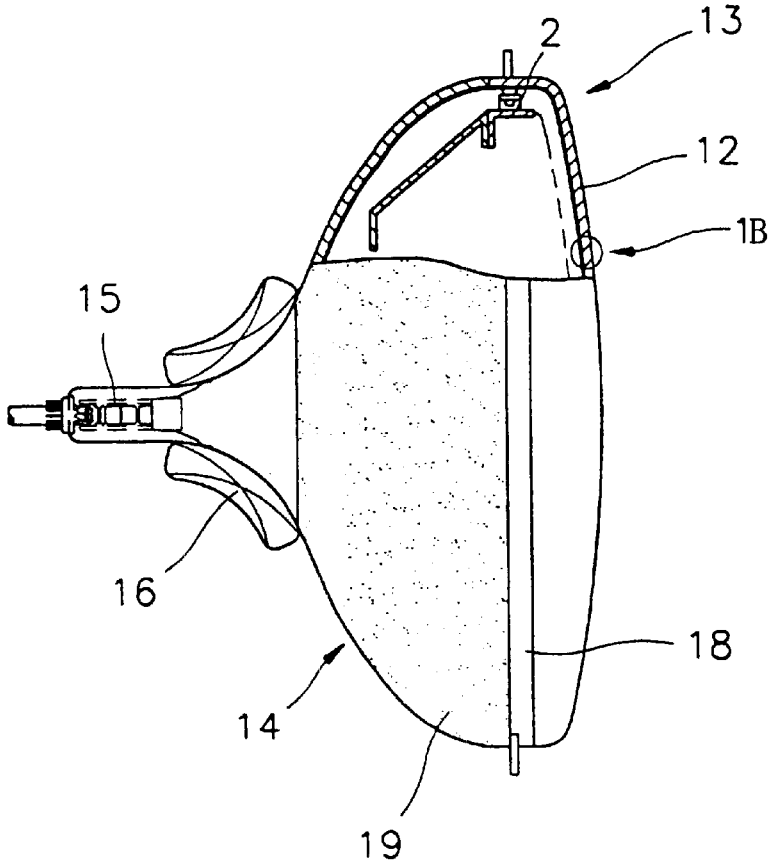
FIG. 1A (PRIOR ART)
FIG. 1A is a sectional view of a conventional cathode ray tube (CRT) and FIG. 1B is a detail view of part of the CRT.
Figure 1B:
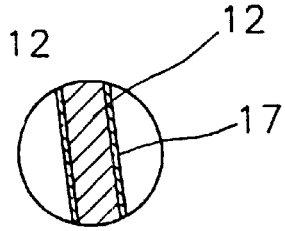
FIG. 1B (PRIOR ART)
Figure 2:
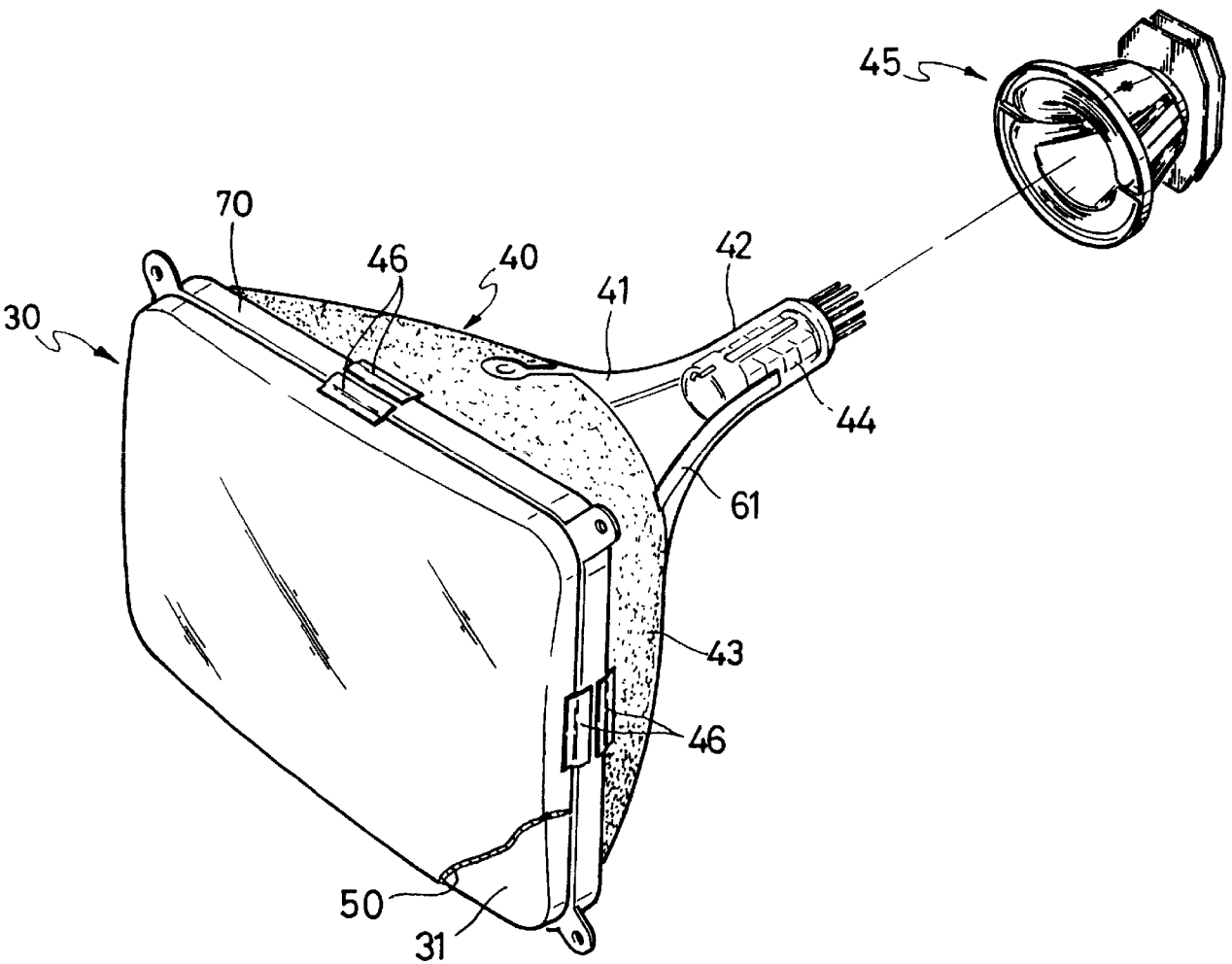
FIG. 2 is an exploded perspective view of a CRT according to a preferred embodiment of the present invention.

Referring to FIG. 2, a cathode ray tube (CRT) according to a preferred embodiment of the present invention comprises a panel 30 with a screen 31 on the inner side of which a fluorescent layer (not shown) is formed, and a funnel 40 which has a cone portion 41 and a neck portion 42 and is connected to the panel 30. An external conductive layer 43 of graphite is located on the outer surface of the funnel 40. An electron gun 44 is inserted in the neck portion 42 and a deflection yoke 45 for deflecting electron beams emitted from the electron gun 44 is installed around the cone portion 44. Also, an implosion band 70 is installed at a contact area between the panel 30 and the funnel 40 to prevent implosion of the CRT. A transparent conductive layer 50 with a resistance greater than $1\times10^5$ Ω/cm$^2$ and less than or equal to $9\times10^5$ Ω/cm$^2$ is formed on the outer surface of the screen 31. Any material which has the above range of resistance and is transparent may be used for the transparent conductive layer 50, and preferably, ITO is used as the material for the transparent conductive layer 50. The transparent conductive layer 50 and the external conductive layer 43 are connected by an electrically conductive tape 46 with the implosion band.

Also, a conductive ground portion 60, which is electrically connected with the external conductive layer 43, is formed on the outer circumference of the cone portion 41, facing the inner circumference of the deflection yoke 45, extending toward the neck portion 42.

Figure 4:
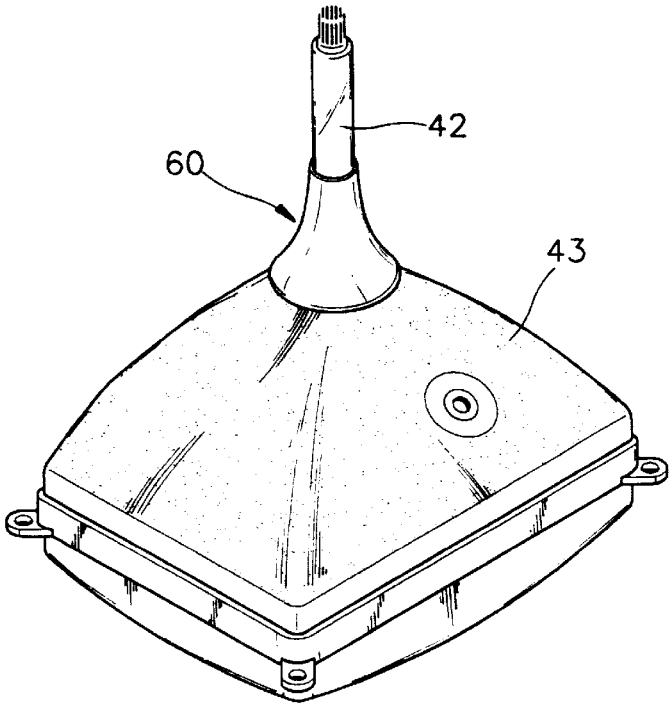
FIG. 4 is a perspective view of an example of a conductive ground portion.
Figure 5:
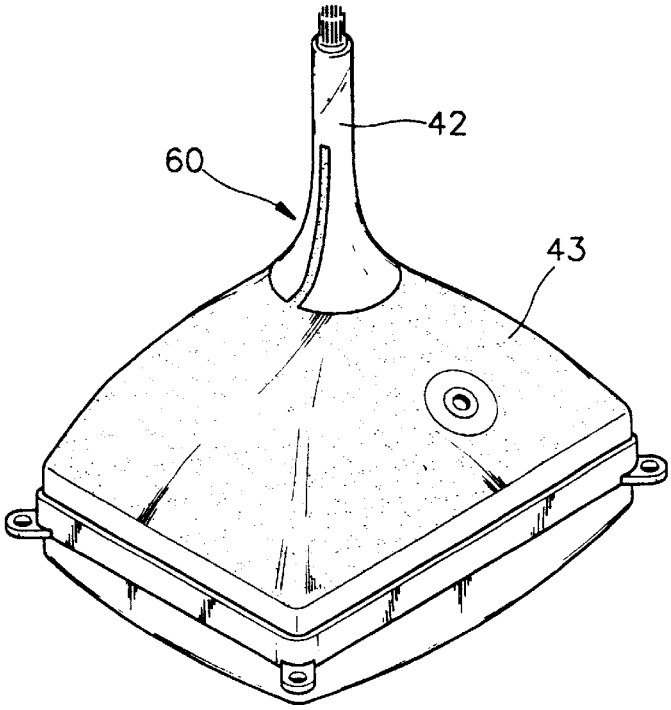
FIG. 5 is a perspective view of another example of the conductive ground portion.

The conductive ground portion 60 may be implemented by attaching a multiple layer film 61 for shielding electromagnetic waves on the outer circumference of the cone portion 41 of the funnel 40 and grounded with the external conductive layer 43. The multiple layer film 60 for shielding electromagnetic waves may be attached to the outer surface of the cone portion 41 in the form of a plurality of strips, contacting the external conductive layer 43, or may be attached around the cone portion 41 as shown in FIG. 4.

Figure 3A:
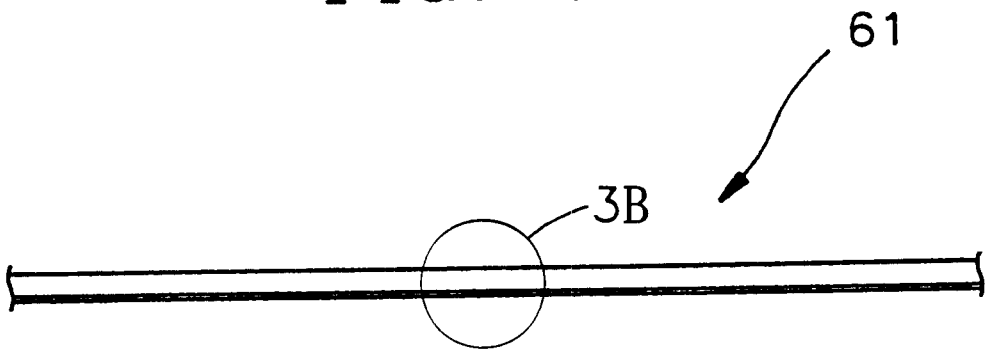
FIG. 3A is a side view of an electron shielding film and FIG. 3B is a detail view of the electron shielding film.
Figure 3B:
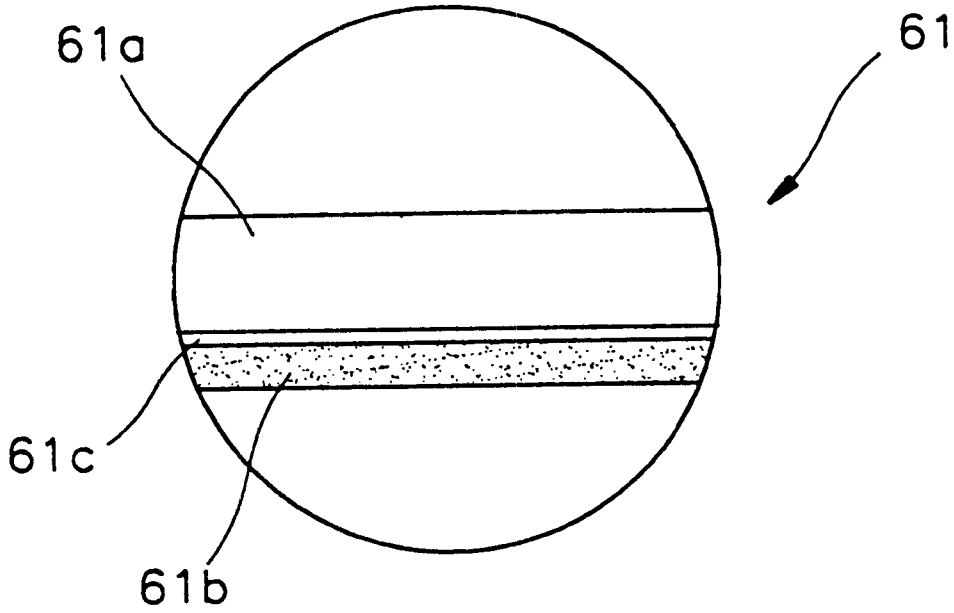

The multiple layer film 61 for shielding the electromagnetic waves includes an insulating film 61*a* and a conductive adhesive layer 61*b* on one surface of the insulating film 61*a* as shown in FIGS. 3A and 3B. Preferably, the conductive adhesive layer 61*b* is formed by mixing in a predetermined ratio, graphite which is heat-resistant and conductive and acrylic adhesives capable of sticking to the cone portion 41. Also, in order to minimize resistance of the conductive adhesive layer 61*b*, an auxiliary conductive material, such as nickel (Ni), may be added. In this case, the conductive adhesive layer 61*b* is made from graphite, Ni and adhesives.

Also, because using only graphite as a conductive material is not enough to lower the resistance to several tens of ohms or less, it is preferable to form a metal layer 61*c* between the insulating film 61*a* and the conductive adhesive layer 61*b* so as to further lower the resistance. The metal layer 61*c* is formed by depositing aluminum (Al) on the conductive adhesive layer 61*b*.

Also, in order to prevent breakdown of the of insulation by leakage current, the insulating film 61*a* on the metal layer 61*c* may be formed of a heat-resistant polyester resin which minimizes the effect of heat generated by the deflection yoke 45 or the CRT. Also, preferably, the thickness of the conductive adhesive layer 61*b* is in the range of 30~40 μm and that of the metal layer 61*c* is of 25~30 μm.

Here, the conductive ground portion 60 may be implemented by the external conductive layer 43 extending toward the neck portion 42 along the cone portion 41 of the funnel around which the deflection yoke 45 is installed. Here, the extended portion of the external conductive layer 43 may be in the shape of strips, a spiral or a lattice with a predetermined width along the cone portion.

During operation of the CRT according to the present invention having the above structure, electromagnetic waves are produced from the deflection yoke 45 and from some parts required for driving the CRT, so electrons charge the external surface of the screen 31 as electron beams emitted by the electron gun 44 scan the fluorescent layer formed inside the screen 31 and land thereon. The generated electromagnetic waves and the electrons charging the screen 31 are absorbed and discharged by the transparent conductive layer 50, the conductive adhesive layer 61*b* of the conductive ground portion 60, the external conductive layer 43 and the implosion band 70. This operation of the CRT will be described in detail.

The conductive ground portion 60 is attached to the external surface of the cone portion 41 of the funnel 40, facing the inner surface of the deflection yoke 45, such that a part of the electromagnetic waves generated by the deflection yoke 45 is absorbed by the conductive adhesive layer 61*b* of the conductive ground portion 60 and then discharged out of the CRT through the external conductive layer 43 and the implosion band 70. As a result, the amount of electromagnetic radiation discharged through the screen of the CRT or backwards is markedly reduced. Such electromagnetic waves not absorbed after generation by the deflection yoke 45 are absorbed by the transparent conductive layer 50 formed on the screen 31. However, because the amount of electromagnetic waves is already sharply reduced before reaching the transparent conductive layer 50, an electromagnetic wave shielding effect satisfying a predetermined level can be achieved even though the transparent conductive layer 50 deposited on the screen 31 is ITO with a relatively high resistance per unit area. For example, a transparent material with a resistance greater than $1\times10^5$ Ω/cm$^2$ and less than or equal to $9\times10^5$ Ω/cm$^2$ is enough to provide the CRT with a predetermined level of electromagnetic wave shielding effect.

The effects of the present invention will be clarified by the following examples.

EXAMPLE 1

A transparent conductive layer was formed on a screen with a material having a resistance of $10^6$~$10^7$ Ω/cm$^2$, and the size of a conductive tape which connects an implosion band to the transparent conductive layer was changed. Also, a conductive ground portion was attached or not to a cone portion, and the amount of electromagnetic radiation emitted from those CRTs was measured. The results are shown in FIG. 6.

Figure 6:
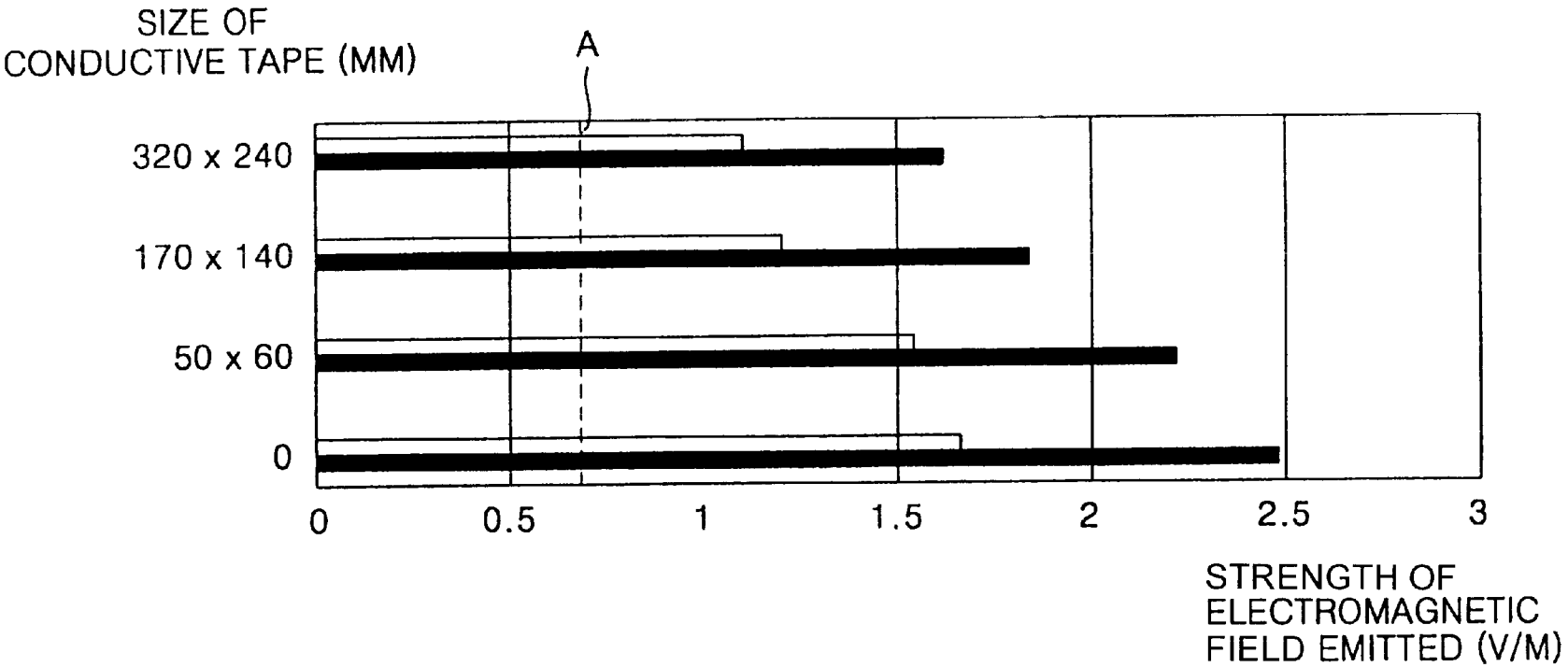
FIGS. 6 and 7 are graphs illustrating the effect of shielding electromagnetic waves by the conductive ground portion according to the present invention.

As shown in FIG. 6, when the conductive ground portion was attached to the cone portion, which is connected to the external conductive layer, the amount of emitted electromagnetic radiation was low compared to the case without the conductive ground portion. However, the electromagnetic wave shielding effect was not enough to satisfy a predetermined limit indicated by dotted line A.

EXAMPLE 2

CRTs were manufactured under the same conditions as in Example 1, except that a transparent conductive layer was formed on a screen with a material having a resistance of $1\times10^5$~$9\times10^5$ Ω/cm$^2$. The results are shown in FIG. 7.

Figure 7:
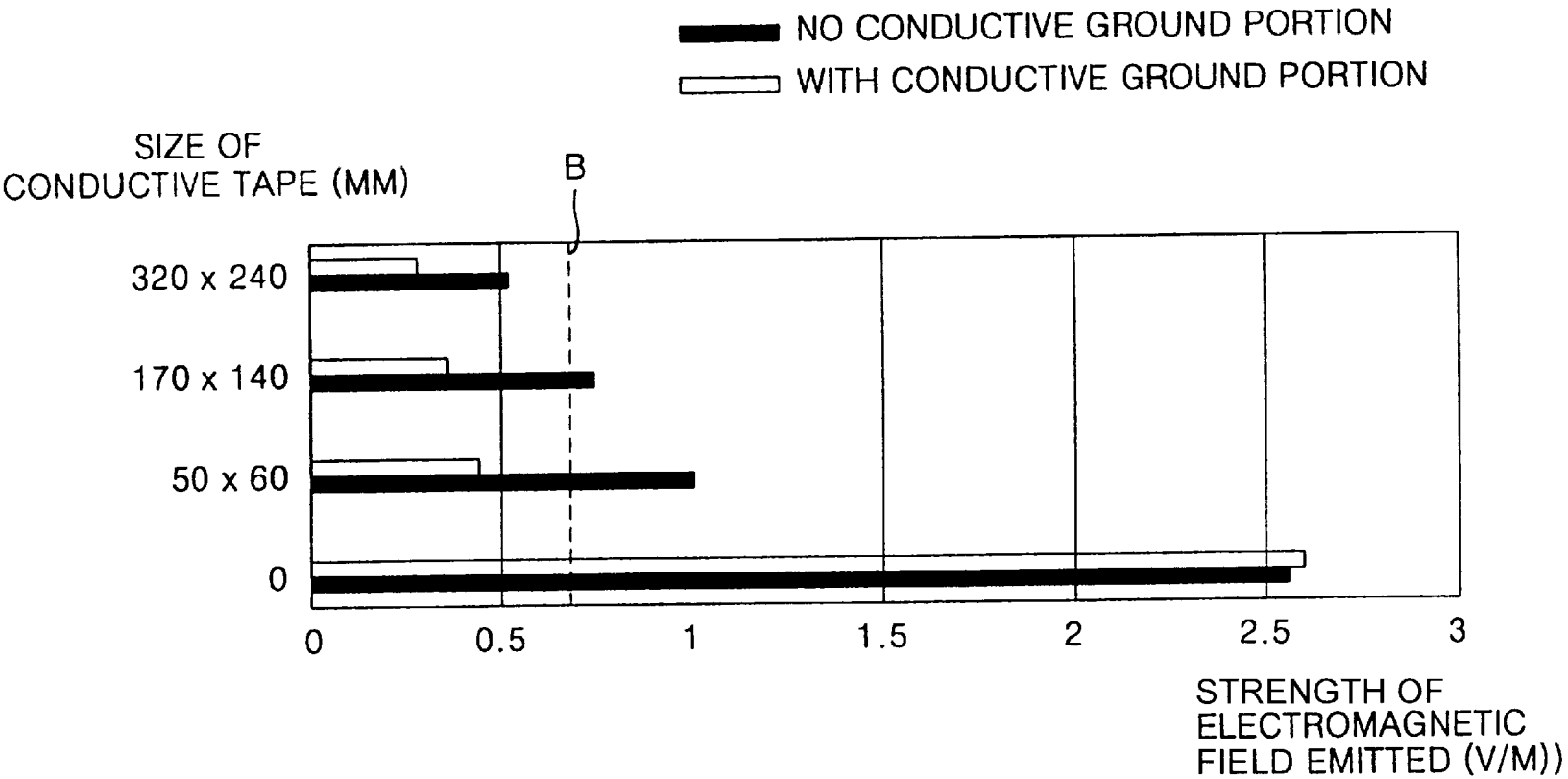

As shown in FIG. 7, when the conductive ground portion was attached to the cone portion, which is connected to the external conductive layer, the amount of emitted electromagnetic waves was within the predetermined range indicated by dotted line B, except for the case where the transparent conductive layer and the implosion band were not grounded by a conductive tape. However, it can be understood that even if the conductive ground portion is not attached, the electromagnetic wave shielding effect required can be achieved by increasing the size of the conductive tape to 320 mm×240 mm or more.

As described above, the CRT according to the present invention uses a material having a relatively high resistance per unit area to form a transparent conductive layer, thereby reducing the manufacturing cost which may be raised by adopting an expensive material for the transparent conductive layer in addition to a high electromagnetic wave shielding effect.

While the present invention has been illustrated and described with reference to specific embodiments, further modifications and alterations within the spirit and scope of this invention as defined by the appended claims will become evident to those skilled in the art.

What is claimed is:

1. A cathode ray tube comprising:

a panel with a screen;

a funnel connected to the panel, having a cone portion and a neck portion;

an electron gun in the neck portion;

an implosion band located at a contact area between the panel and the funnel to prevent implosion of the cathode ray tube;

a deflection yoke installed around the cone portion;

an external electrically conductive layer disposed on an external surface of the cone portion;

an indium tin oxide layer disposed on an outer surface of the screen, electrically connected to the implosion band and to the external electrically conductive layer, and having a sheet resistivity greater than $1\times10^5$ $\Omega/cm^2$ and not more than $9\times10^5$ $\Omega/cm^2$; and an electrically conductive ground portion strip comprising an insulating film and an electrically conductive adhesive layer on a surface of the insulating film, electrically connected to the external electrically conductive layer, attached to the cone and neck portions of the funnel, disposed between the cone portion of the funnel and the deflection yoke, and extending from the neck portion of the funnel to the cone portion.

2. The cathode ray tube of claim 1, wherein the electrically conductive adhesive layer is a mixture of graphite and acrylic adhesives.

3. The cathode ray tube of claim 1, wherein the electrically conductive adhesive layer includes an auxiliary conductive material.

4. The cathode ray tube of claim 3, wherein the auxiliary conductive material is nickel.

5. The cathode ray tube of claim 1, wherein the electrically conductive ground portion includes a metal layer located between the insulating layer and the electrically conductive adhesive layer.

6. A cathode ray tube comprising:

a panel with a screen;

a funnel connected to the panel, having a cone portion and a neck portion;

an electron gun in the neck portion;

an implosion band located at a contact area between the panel and the funnel to prevent implosion of the cathode ray tube;

a deflection yoke installed around the cone portion;

an external electrically conductive layer disposed on an external surface of the cone portion but not on the neck portion;

an indium tin oxide layer disposed on an outer surface of the screen, electrically connected to the implosion band and to the external electrically conductive layer, and having a sheet resistivity greater than $1\times10^5$ $\Omega/cm^2$ and not more than $9\times10^5$ $\Omega/cm^2$; and an electrically conductive ground portion strip comprising an insulating film and an electrically conductive adhesive layer on a surface of the insulating film, electrically connected to the external electrically conductive layer, attached to the cone and neck portions of the funnel, disposed between the cone portion of the funnel and the deflection yoke, and extending from the neck portion of the funnel to the cone portion.

7. The cathode ray tube of claim 6, wherein the electrically conductive adhesive layer is a mixture of graphite and acrylic adhesives.

8. The cathode ray tube of claim 6, wherein the electrically conductive adhesive layer includes an auxiliary conductive material.

9. The cathode ray tube of claim 8, wherein the auxiliary conductive material is nickel.

10. The cathode ray tube of claim 6, wherein the electrically conductive ground portion includes a metal layer located between the insulating layer and the electrically conductive adhesive layer.

* * * * *